United States Patent [19]

Crandall

[11] Patent Number: 4,583,841

[45] Date of Patent: Apr. 22, 1986

[54] ELECTROGRAPHIC COPIER DEVELOPER STATION

[75] Inventor: Robert P. Crandall, Webster, N.Y.

[73] Assignee: Eastman Kodak Company, Rochester, N.Y.

[21] Appl. No.: 633,564

[22] Filed: Jul. 23, 1984

[51] Int. Cl.[4] ..... G03G 15/09

[52] U.S. Cl. ..... 355/3 DD; 118/657; 118/661; 354/318; 355/10

[58] Field of Search ..... 355/3 R, 3 DD, 10; 118/656, 657, 658, 661; 354/317, 318

[56] References Cited

U.S. PATENT DOCUMENTS

| | | | |
|---|---|---|---|
| 3,145,122 | 8/1964 | Streich | 118/658 |
| 3,641,896 | 2/1972 | Downey et al. | 354/317 X |
| 3,641,969 | 2/1972 | Hakanson | 118/658 X |
| 4,077,358 | 3/1978 | Kito | 118/658 |
| 4,460,267 | 7/1984 | Ogawa | 355/3 DD |
| 4,465,361 | 8/1984 | Rumsey | 355/3 DD X |

*Primary Examiner*—Fred L. Braun
*Attorney, Agent, or Firm*—Lawrence P. Kessler

[57] ABSTRACT

A developer station for use in an electrographic copier utilizing moving discrete dielectric sheets, such sheets being adapted to respectively carry latent image charge patterns and travel along a path in pattern-developing relation to such station. The developer station includes a housing forming a reservoir for developer material. The housing has an opening in juxtaposition with the travel path. Developer material is transported from the reservoir through such opening and into such travel path. A movable shielding belt blocks the opening to prevent developer material from reaching the travel path. In response to approach of a discrete dielectric sheet moving along the travel path toward the station, the belt is moved to a position where a window through the belt overlies the opening thereby unblocking such opening to enable transported developer material to contact a discrete dielectric sheet when such sheet is in pattern-developing relation to the developer station.

6 Claims, 5 Drawing Figures

ELECTROGRAPHIC COPIER DEVELOPER STATION

BACKGROUND OF THE INVENTION

This invention relates generally to developer stations for electrographic copiers, and more particularly to a developer station in an electrographic copier utilizing a plurality of moving discrete dielectric sheets for developing latent image charge patterns carried by such sheets.

In U.S. Pat. No. 4,436,405 issued Mar. 13, 1984 in the name of Kindt, an electrographic copier is described which utilizes a plurality of discrete photoconductive sheets. The sheets are transported seriatim about a continuous path into operative relation with electrographic process stations to make information reproductions. In the reproduction process carried out at such process stations of the copier, a sheet is uniformly charged and then exposed by an image of information to be reproduced (e.g., a document) to form a latent image charge pattern on such sheet corresponding image-wise to such information. The charge pattern is developed with pigmented thermoplastic electroscopic marking particles electrostatically attracted to the charge pattern to form a transferable image. The transferable image is then transferred from the sheet to a receiver member to form the information reproduction, and the sheet is cleaned for reuse.

Development of the charge patterns on the discrete sheets is accomplished by a magnetic brush developer apparatus such as shown in U.S. Pat. No. 3,703,395 issued Nov. 21, 1972 in the name of Drexler et al, for example. In typical magnetic brush developer apparatus, developer material including pigmented electroscopic marking particles adhering to magnetizable particles (or single component material where the pigmented particles are magnetizable) are brought into a magnetic field intercepting the path of a charge pattern carrying member. The magnetizable particles align in the field to form brush-like bristles of pigmented particles which contact such member. The pigmented particles are electrostatically attracted to the charge pattern and adhere to such pattern for development. However, when the charge pattern carrying member is a plurality of discrete sheets, there is a propensity for such sheets to plow through the bristles. This can lead to deposition of developer material on the back side of the sheets. Therefore, cleaning of the sheets is made more complex (i.e. cleaning of the back sides must also be effected). Moreover, contamination within copier environment by airborne developer material, or non-transferred developer material carried out of the developer station by the sheets, is potentially increased.

SUMMARY OF THE INVENTION

This invention is directed to a developer station for use in an electrographic copier utilizing moving discrete dielectric sheets, such sheets being adapted to respectively carry latent image charge patterns and travel along a path in pattern-developing relation to such station. The developer station includes a housing forming a reservoir for developer material. The housing has an opening in juxtaposition with the travel path. Developer material is transported from the reservoir through such opening and into such travel path. A movable shielding belt blocks the opening to prevent developer material from reaching the travel path. In response to approach of a discrete dielectric sheet moving along the travel path toward the station, the belt is moved to a position where a window through the belt overlies the opening thereby unblocking such opening to enable transported developer material to contact a discrete dielectric sheet when such sheet is in pattern-developing relation to the developer station.

The invention, and its objects and advantages, will become more apparent in the detailed description of the preferred embodiment presented below.

BRIEF DESCRIPTION OF THE DRAWINGS

In the detailed description of the preferred embodiment of the invention, reference is made to the accompanying drawings, in which.

DESCRIPTION OF THE PREFERRED EMBODIMENT

Figure 1:
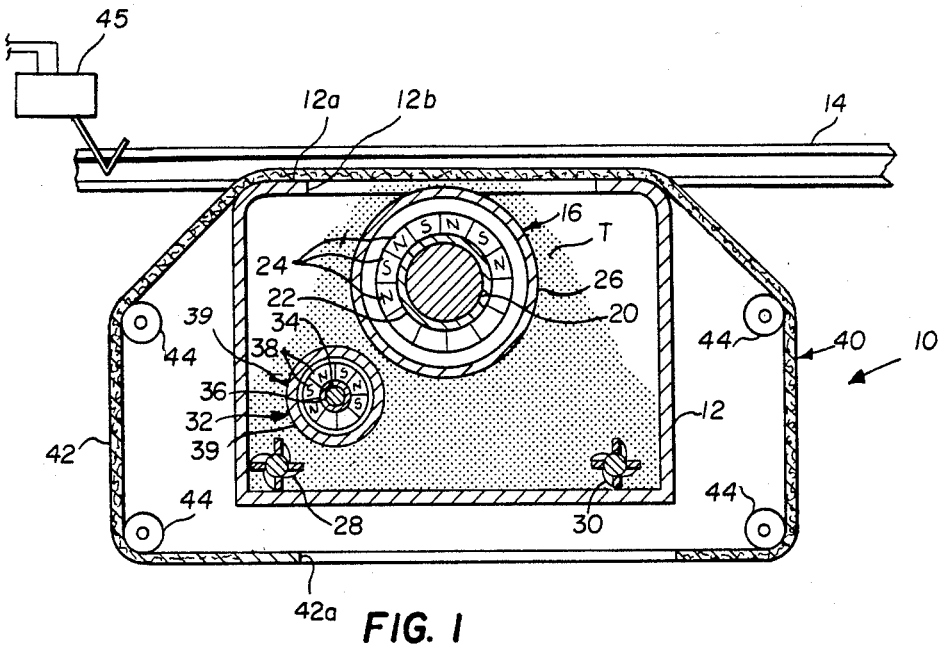
FIG. 1 is a side elevational view, in cross-section, of a magnetic brush developer station according to this invention for use in an electrographic copier utilizing moving discrete dielectric sheets.
Figure 2:
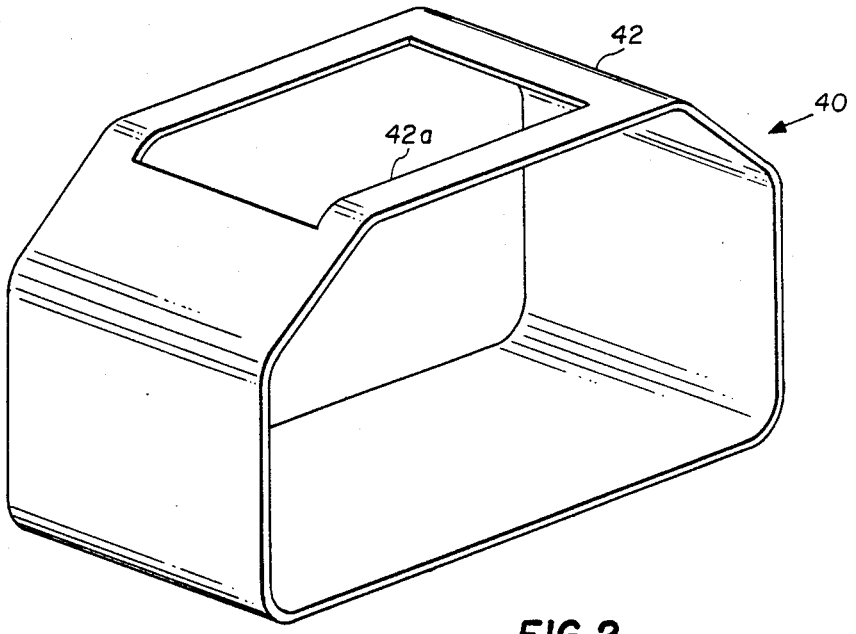
FIG. 2 is a view, in perspective, of the shield for the developer station of FIG. 1.

Referring now to the accompanying drawings, a magnetic brush developer station, designated generally by the numeral 10, is shown in FIG. 1. The developer station 10 includes a housing 12 forming a reservoir for particulate developer material T. The developer material T comprises, for example, a mixture of finely divided pigmented thermoplastic electroscopic marking particles (toner) held to the surface of ferromagnetic particles (carrier) by electrostatic charges created by triboelectrification. Of course, developer material of the type comprised solely of marking particles which exhibit magnetic properties (referred to as single component developer) is also suitable for use with this invention.

The housing 12 of developer station 10 includes a top wall **12*a* in which an opening 12*b* is defined. The opening 12*b* is located in juxtaposition with a portion 14** of a track assembly of an electrographic copier utilizing moving discrete dielectric sheets, such as for example the aforementioned U.S. Pat. No. 4,436,405. The track assembly of the copier of such patent describes a path about which discrete dielectric sheets are transported and guided into operative relation with electrographic process stations. The sheets, which include a photoconductive layer, a conductive layer, and an insulating layer, are uniformly charged and then exposed over an image-receiving area by a light image of information to be reproduced. Such exposure selectively reduces the uniform charge to form latent image charge patterns on the sheets respectively corresponding image-wise to the light images. The charge patterns are developed by electroscopic marking particles to form transferable images on the sheets, and such images are then transferred from the sheets to receiver members to form the information reproductions. Of course, the developer station of this invention is suitable for use in other copier apparatus utilizing discrete dielectric sheets such as, for example, where the developed images on such sheets are fixed to the sheets.

An applicator 16, mounted in the housing 12 of the developer station 10, is adapted to transport developer material through the opening 12*b* into the sheet path described by track assembly portion 14. The applicator 16 includes a stationary substantially cylindrical core 20 of non-magnetic material, such as aluminum for example. The longitudinal axis of the core 20 extends laterally with respect to the track assembly portion 14, perpendicular to the direction of travel of a discrete sheet in such portion. A stationary magnetic pole piece 22 is adhesively bonded to the core 20. A plurality of permanent magnets 24, of rubber-bonded barium ferrite strips for example, are fixed on a portion of the periphery of the pole piece 22. A shell 26, rotatably mounted in the housing 12 concentrically with the core 20, surrounds the magnet arrangement in the field of the permanent magnets. The shell is a hollow cylinder or tube of non-magnetic material, such as aluminum, with a roughened peripheral surface.

Augers 28 and 30, supported in the housing 12 so as to extend through the developer material T, are rotated to circulate the developer material in the housing and distribute it along the length of shell 26. In the instance where the developer material includes carrier and toner particles, such circulation also causes the toner particles to develop a triboelectric charge which results in the adhering of the toner particles to the carrier particles. A feed member 32 transports developer material in the reservoir to the shell 26. The feed member, which is similar in construction to the applicator 16, includes a stationary cylindrical core 34, a pole piece 36, permanent magnets 38 (producing magnetic fields of relatively lesser strength than the magnetic fields produced by magnets 24), and a rotatable shell 39.

As the shell 39 rotates, the carrier particles and adhering toner particles (or the single component developer material) are held on the roughened peripheral surface of such shell by the magnetic fields of the permanent magnets 38 and are transported toward the shell 26. The developer material is transferred from shell 39 to shell 26 by the relatively stronger magnetic fields of the magnets 24 and held on the surface of shell 26. The particles in the fields of the magnets 24 establish a brush nap in the form of bristles extending substantially radially from the shell 26. As the shell 26 rotates the bristles are moved through the opening 12*b* in the top wall 12*a* of the developer station housing 12 and into the path of a discrete sheet. Of course, other magnetic brush confirguations (e.g., plural applicators; stationary shell with rotating magnets) for establishing path-intercepting developer material bristles are suitable for use with this invention.

In order to prevent the discrete sheets transported through the track assembly portion 14 from plowing through the developer material bristles, the developer station 10 further includes a shield 40. The shield 40 is a dimensionally stable flexible belt 42, of polyethelene for example, having a window 42*a* configured to be substantially congruent to the image-receiving area of a discrete sheet. The belt 42 is supported on rollers 44 and the top 12*a* of housing 12. One of the rollers 44 serves to drive the belt 42 about its closed loop path defined by the supporting rollers and housing top 12*a* such that the window 42*a* periodically overlies the opening 12*b* in the housing top. As the window 42*a* passes over the opening 12*b*, developer material bristles are free to be moved into the path described by track assembly portion 14 in pattern developing relation with a discrete sheet transported through such portion. At all other times, the developer material is confined by the belt 42 to the housing 12. This reduces potential contamination within the copier environment by preventing airborne material from leaving the housing.

Figure 3:
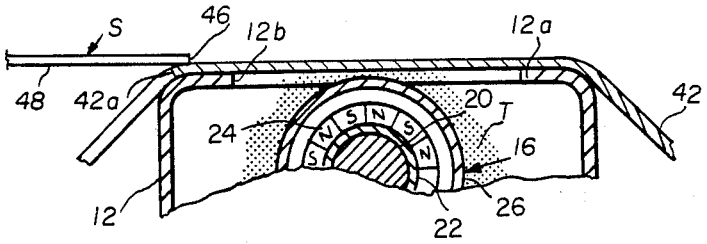
FIGS. 3–5 are side elevational views similar to FIG. 1, in cross-section, of the developer station according to this invention taken at different times during station operation, and with portions removed to facilitate viewing.

In operation, the belt 42 is driven about its closed loop path in timed relation to the transport of a discrete sheet through the track assembly portion 14. Such timing is controlled, for example, by utilizing a sensor 45 to detect the presence of a sheet upstream of the station and having such sensor produce a signal in response to such detection to initiate drive of belt 42. The logic and control unit of the aforementioned U.S. Pat. No. 4,436,405 can readily accommodate this control function. As the lead edge 46 of a discrete sheet S approaches the housing 12 of the developer station 10, the window 42*a* of belt 42 approaches the top 12*a* of the housing (see FIG. 3). The timing is selected such that the lead edge 46 overlies the non-windowed portion of the belt adjacent to the lead edge of the opening 12*b*. Thus, as the lead edge 46 traverses the station 10, it is shielded by the belt 42 and prevented from plowing through the developer material bristles.

Figure 4:
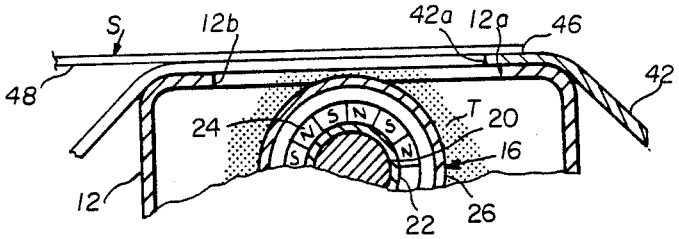
Figure 5:
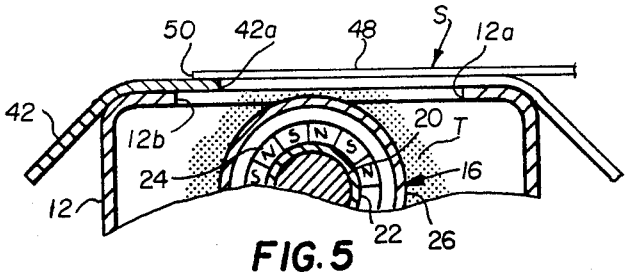

On further movement of the sheet S and belt 42, the image-receiving area of the sheet lies within the window 42*a* and is free to be contacted by the developer material bristles (see FIG. 4) for charge pattern development in the manner described above. Of course, the peripheral speed of the belt 42 is selected to match the peripheral speed of the sheet S so that there is no relative movement between the belt and the sheet. As noted above, the window and the image-receiving area of the sheet are substantially congruent. Accordingly, the complete charge pattern in such image-receiving area is capable of being developed. Moreover, as the trail edge 50 of the sheet S approaches the developer material bristles, it overlies the non-windowed portion of the belt 42 adjacent to the trail edge of the opening 12*b* (see FIG. 5). This serves to prevent developer material from depositing on the backside of the sheet. In this manner developer material is always contained within the station 10 and copier contamination is substantially prevented.

The invention has been described in detail with particular reference to a preferred embodiment thereof, but it will be understood that variations and modifications can be effected within the spirit and scope of the invention.

I claim:

1. Developer station for use in an electrographic copier utilizing moving discrete dielectric sheets adapted to respectively carry latent image charge patterns and travel along a path in pattern-developing relation to such station, said developer station comprising:

a housing forming a reservoir for developer material and having an opening in juxtaposition with the travel path;

means for transporting developer material from such reservoir through said opening and into such travel path;

a shielding belt defining a window through a portion thereof, means for supporting said shielding belt, between said said opening and such travel path, for movement to a position for blocking said opening to prevent developer material from reaching such travel path and to a position where said window overlies said opening for unblocking said opening; and means, responsive to approach of a discrete dielectric sheet moving along such travel path toward pattern-developing relation to the station, for moving said shielding belt from its blocking position to its position where said window overlies said opening to enable transported developer material to contact such discrete dielectric sheet when such sheet is in pattern-developing relation to the developer station.

2. The invention of claim 1 wherein said moving means further includes means for moving said belt across said opening in timed relation to movement of a discrete dielectric sheet along its travel path, whereby the charge pattern carrying area of such discrete dielectric sheet and said window are substantially simultaneously aligned while such sheet is in pattern-developing relation to the developer station.

3. The invention of claim 2 wherein said window is substantially congruent with the charge pattern carrying area of a discrete sheet.

4. For use in an electrographic copier utilizing discrete dielectric sheets traveling along a path in operative relation with electrographic process stations to form respective latent image charge patterns on such sheets and develop such charge patterns with developer material, such station for developing such charge patterns having a housing adapted to contain developer material and defining an opening in juxtaposition with such travel path, an applicator adapted to transport such developer material through said opening into pattern-developing relation with such discrete dielectric sheets moving along such path, and means for selectively shielding said opening of such developer station, said shielding means comprising:

a belt, interposed between said housing and said travel path, said belt having a portion for blocking said opening to seal such opening and prevent developer material from leaving said housing, and defining a window through which developer material is able to leave said housing; and means, responsive to approach of a discrete dielectric sheet moving along such travel path toward said developer station, for moving said belt to a location where said window overlies said opening to enable developer material to be transported into pattern-developing relation with such discrete dielectric sheet when such discrete dielectric sheet travels through such travel path adjacent to such opening.

5. The invention of claim 4 wherein said window is substantially congruent with the charge pattern carrying area of a discrete dielectric sheet, and wherein said belt is supported for movement in a closed loop path, in part overlying said opening, whereby the non-windowed portion of said belt seals said opening and, when said non-windowed portion is moved to a location remote from said opening, developer material is enabled to be transported through said window into pattern-developing relation with a discrete dielectric sheet.

6. The invention of claim 5 wherein said moving means includes a sensor for detecting the approach of a discrete dielectric sheet toward said developer station, said sensor producing a signal to initiate movement of said belt in timed relation to movement of such sheet whereby the lead edge of such sheet overlies the non-windowed portion of said belt adjacent to said opening to prevent such sheet from plowing through the developer material.

* * * * *